US009228266B2

(12) United States Patent
Nishimoto et al.

(10) Patent No.: US 9,228,266 B2
(45) Date of Patent: Jan. 5, 2016

(54) PICKLING METHOD AND PICKLING SYSTEM OF STEEL PLATE

(75) Inventors: Takumi Nishimoto, Tokyo (JP); Kenichi Uemura, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 821 days.

(21) Appl. No.: 13/513,204

(22) PCT Filed: May 25, 2010

(86) PCT No.: PCT/JP2010/059167

§ 371 (c)(1),
(2), (4) Date: Jun. 1, 2012

(87) PCT Pub. No.: WO2011/067955

PCT Pub. Date: Jun. 9, 2011

(65) Prior Publication Data

US 2012/0240956 A1 Sep. 27, 2012

(30) Foreign Application Priority Data

Dec. 3, 2009 (JP) ..... 2009-275801

(51) Int. Cl.

| | |
|---|---|
| ***B08B 3/12*** | (2006.01) |
| ***C23G 1/08*** | (2006.01) |
| ***C23G 3/00*** | (2006.01) |
| ***C23G 3/02*** | (2006.01) |

(52) U.S. Cl.
CPC ... *C23G 1/08* (2013.01); *B08B 3/12* (2013.01); *C23G 3/00* (2013.01); *C23G 3/021* (2013.01)

(58) Field of Classification Search
None
See application file for complete search history.

(56) References Cited

U.S. PATENT DOCUMENTS

| | | | | |
|---|---|---|---|---|
| 5,656,095 | A | 8/1997 | Honda et al. | |
| 2008/0289971 | A1 | 11/2008 | Shigihara et al. | |
| 2010/0151201 | A1* | 6/2010 | Erickson et al. | 428/148 |

FOREIGN PATENT DOCUMENTS

| | | | |
|---|---|---|---|
| JP | 61-235584 | A | 10/1986 |
| JP | 4-341588 | A | 11/1992 |
| JP | 5-125573 | A | 5/1993 |
| JP | 10-251911 | A | 9/1998 |

(Continued)

OTHER PUBLICATIONS

EPO machine translation of JP 2005298937 retrieved from http://worldwide.espacenet.com/publicationDetails/biblio?CC=JP&NR=2005298937A&KC=A&FT=D&ND=3&date=20051027&DB=worldwide.espacenet.com&locale=en_EP on Mar. 23, 2015.*

(Continued)

*Primary Examiner* — Eric Golightly
(74) *Attorney, Agent, or Firm* — Birch, Stewart, Kolasch & Birch, LLP

(57) ABSTRACT

The present invention is a method of pickling of steel plate which contains silicon comprising applying ultrasonic waves of at least two types of frequencies of 28.0 kHz or more to less than 1.0 MHz to an acidic cleaning solution which contains microbubbles and, in that state, dipping the steel plate which contains silicon in that cleaning solution. The present invention is a continuous pickling system of steel plate which contains silicon which is provided with at least a support part which supports the steel plate, a conveyor which makes the steel plate move, and a pickling tank which pickles the steel plate, wherein the pickling tank has means for feeding microbubbles and means for applying ultrasonic waves of at least two types of frequencies of 28.0 kHz or more to less than 1.0 MHz.

9 Claims, 2 Drawing Sheets

(56) References Cited

FOREIGN PATENT DOCUMENTS

| | | | |
|---|---|---|---|
| JP | 2000-256886 | A | 9/2000 |
| JP | 2003-313688 | A | 11/2003 |
| JP | 2005-200697 | A | 7/2005 |
| JP | 2005-298937 | A | 10/2005 |
| JP | 2007-253120 | A | 10/2007 |
| JP | 2008-253373 | A | 10/2008 |
| WO | WO 2006/001293 | A1 | 1/2006 |

OTHER PUBLICATIONS

Extended European Search Report dated Oct. 16, 2013 issued in corresponding European Patent Application No. 10834408.6.

International Search Report issued in PCT/JP2010/059167, mailed on Sep. 7, 2010.

* cited by examiner

PICKLING METHOD AND PICKLING SYSTEM OF STEEL PLATE

TECHNICAL FIELD

The present invention relates to a pickling method and pickling system of steel plate, in particular, relates to a method and system which efficiently remove oxide scale which is formed in the process of production of steel plate which contains Si.

BACKGROUND ART

In the process of production of steel plate, the steel plate surface is cleaned for various purposes. For example, cleaning of the steel plate before plating or coating, removal of oxide scale (descaling) by pickling hot rolled steel plate, etc. may be mentioned. Regarding descaling, usually steel plate is formed with oxide scale on the steel plate surface in the process of being heat treated and rolled, so the oxide scale has to be removed. That is, the oxide scale is often caught at the rolling rolls and causes damage to the surface of the steel plate at the time of the later step of cold rolling, so descaling is a necessary and essential step. For conventional oxide scale removal, the steel plate is often dipped into a plurality of acidic solutions and continuously run so as to remove the scale by pickling.

Acceleration or increasing efficiency of cleaning of such steel plate, improvement of the cleaning ability, etc. largely depend on the design of the cleaning solution, but as one method for further assisting cleaning at the time of cleaning, the method of applying 20 to 100 kHz ultrasonic waves is described in PLT's 1, 2, and 3. If applying ultrasonic waves inside the cleaning solution, a cavitation phenomenon occurs at the surface of the steel plate being cleaned and the cleaning effect is promoted. That is, due to the ultrasonic waves, the pressure locally falls and becomes lower than steam pressure inside the cleaning solution, so water vapor is formed and the dissolved gas expands resulting in small bubbles or cavities being rapidly formed and quickly collapsing. Due to this, the chemical reaction of the cleaning is promoted and also an impact force is given so the cleaning effect is promoted. Therefore, application of ultrasonic waves is also effective for pickling descaling of hot rolled steel plate.

Further, in PLT 4 or 5, solid particles are made to disperse through the cleaning solution whereby the effect of application of ultrasonic waves is further assisted.

Further, PLT 6 describes addition of microbubbles so as to further improve the cleaning effect due to application of ultrasonic waves. When only applying ultrasonic waves to the cleaning solution and pickling solution, when jointly using microbubbles, the range of propagation of the ultrasonic waves spreads three-dimensionally, so the object being cleaned can be uniformly cleaned.

Further, while the object being cleaned is a glass sheet or semiconductor wafer, PLT 7 discloses feeding a cleaning solution which contains microbubbles to the object being cleaned and applying ultrasonic waves combining a plurality of frequencies. The reason for combining a plurality of frequencies is to crush the microbubbles by the 5 to 800 kHz low frequency ultrasonic waves so as to generate microbubble radicals and to effectively mix the microbubble radicals by the 1 MHz or higher high frequency ultrasonic waves. Effective cleaning becomes possible because of this.

For the pickling descaling, sulfuric acid, hydrochloric acid, nitric acid, fluoric acid, etc. alone or variously mixed to form a pickling solution may be used. To increase the pickling rate of the pickling solution, increasing the acid concentration, raising the pickling temperature, etc. have been attempted, but there are minus aspects such as the increase in chemicals and energy costs and the roughening of the steel material surface after pickling, so there are limits to improvement of the pickling rate and therefore ultrasonic waves are jointly used. However, reduction of the manufacturing costs of steel plate and improvement of the quality of steel plate are desired. For the cleaning and descaling of steel plate as well, further improvement of the cleaning efficiency and improvement of the cleanliness of the surface of steel plate are necessary.

CITATIONS LIST

Patent Literature

PLT 1: Japanese Patent Publication (A) No. 4-341588
PLT 2: Japanese Patent Publication (A) No. 2003-313688
PLT 3: Japanese Patent Publication (A) No. 5-125573
PLT 4: Japanese Patent Publication (A) No. 61-235584
PLT 5: Japanese Patent Publication (A) No. 10-251911
PLT 6: Japanese Patent Publication (A) No. 2000-256886
PLT 7: Japanese Patent Publication (A) No. 2007-253120

SUMMARY OF INVENTION

Technical Problem

If trying to jointly use ultrasonic waves for pickling of steel plate so as to improve the cleaning effect and efficiency of steel plate, since ultrasonic waves have directionality, the generator of the ultrasonic waves has to be placed directly under the steel plate. On top of this, depending on the placement conditions, the problem arises that sometimes the desired dissolution rate of the oxide scale will not be able to be obtained or uniform pickling in the width direction will be difficult.

Furthermore, at the time of removal of oxide scale, bubbles are formed due to the reaction between the steel plate and acid inside the pickling tank, so when using a low frequency, there is also the problem that these bubbles will obstruct propagation of the ultrasonic waves and the effect of improvement of the dissolution of oxide scale by ultrasonic waves will fall.

Therefore, even if trying to apply ultrasonic waves for pickling of steel plate, it is difficult to sufficiently achieve an improvement in the rate of dissolution of oxide scale.

Furthermore, along with the increasingly higher strengths and higher functions of steel plate in recent years, various elements are being added to steel plate. For this reason, the additional elements sometimes concentrate at the interface between the oxide scale and the steel plate. When such a concentrated layer of additional elements is formed, in the pickling, uneven dissolution of the oxide scale ends up occurring.

In particular, when the additional elements include silicon (Si), since the dissolution of Si oxides in the acid cleaning solubility is small, it is learned empirically that if using the conventional pickling methods for treatment, the dissolution rate becomes slower. Furthermore, it is observed that the once dissolved Si oxide scale changes to a gel and redeposits on the steel plate surface.

In the case of silicon steel plate and other steel plate containing a large amount of Si, this phenomenon becomes further conspicuous. Si in steel concentrates as oxides at the base iron side of the oxide scale layer, so it is necessary to dissolve away the Si oxide layer which is formed between the oxide scale layer and base iron so as to remove the entire oxide scale.

Further, as mentioned above, Si oxide scale, sometimes becomes a gel state in the pickling solution and deposits on the surface of the steel plate depending on the concentration of Si ions in the solution, so from this viewpoint, a method of completely dissolving away Si oxide scale is being sought.

For dissolving away this oxide scale, in particular, Si oxide scale, a sufficient dissolution rate of the scale cannot be obtained at the present with the conventional pickling method. For this reason, not only cannot the line speed of the pickling be raised and good efficiency pickling not be performed, but also the productivity cannot be raised due to this factor.

For example, in PLT 4 or 5, there is also the method of dispersing solid particles in the cleaning solution used for the ultrasonic wave cleaning, but the above problem cannot be solved by just applying ultrasonic waves and dispersing solid particles in the cleaning solution in the pickling of steel plate. The reason is that in pickling of steel plate which contains Si, the cleaning rate is not improved and uniform cleaning is also not possible.

As shown in PLT 6, even if simply applying ultrasonic waves to a cleaning solution to which microbubbles have been added, unless an average bubble size of the microbubbles corresponding to the frequency of the ultrasonic waves is selected, the ultrasonic waves will be greatly attenuated due to collision and reflection of microbubbles and a sufficient cleaning effect will no longer be obtained or uniform cleaning will not be possible. Furthermore, as shown in PLT 7, even if applying a plurality of ultrasonic waves including 1 MHz or higher high frequency ultrasonic waves, what the microbubble radicals can be used to clean is limited to contaminating organic matter. This is not necessarily effective for cleaning off oxide scale.

Furthermore, it may be considered to disperse both solid particles and microbubbles in a cleaning solution, but the inventors actually studied this and as a result found that even if just adding both solid particles and microbubbles to a cleaning solution, the solid particles detracted from the stabilization of the microbubbles (resulting in microbubbles agglomerating) and the solid particles were trapped in the microbubbles or at the vapor-liquid interfaces and could not be efficiently dispersed in the cleaning solution, so therefore, rather, the cleaning power fell and effective cleaning or uniform cleaning was not possible.

The present invention has as its object to solve such problems in the prior art and to provide a pickling method and pickling system of steel plate which can efficiently and uniformly remove oxide scale (including Si oxide scale) which is formed in the process of production of steel plate which contains Si.

Solution to Problem

The inventors engaged in intensive studies on means for solving the above problems and as a result discovered that by applying ultrasonic waves of at least two types of frequencies to an acidic cleaning solution which contains microbubbles, the high frequency ultrasonic waves are superposed on the low frequency ultrasonic waves so the high frequency ultrasonic waves are easily be propagated further and, further, are scattered by the microbubbles, so ultrasonic waves area uniformly and efficiently propagated to the steel plate surface, and thereby completed the present invention. By superposing ultrasonic waves of two frequencies, the belly part of the ultrasonic waves are not fixed in place and uniformity of propagation of energy of ultrasonic waves is improved.

Further, the inventors discovered that to dissolve away oxide scale or Si oxide scale, the effect differs depending on the frequency of the ultrasonic waves. In particular, they discovered that if applying ultrasonic waves of at least two types of frequencies in the range of 28.0 kHz or more to less than 1.0 MHz frequency, the oxide scale or Si oxide scale of steel plate can be efficiently and effectively removed.

That is, the gist of the present invention is as follows:

(1) A method of acid cleaning of steel plate which contains silicon, the method of acid cleaning of steel plate characterized in that acid cleaning solution contains microbubbles, ultrasonic waves which have at least two types of frequencies are applied to the acid cleaning solution, and the frequencies of the ultrasonic waves are frequencies of 28.0 kHz or more to less than 1.0 MHz.

(2) A method of acid cleaning of steel plate as set forth in (1), characterized in that in the frequencies of ultrasonic waves, a lowest frequency f1 and a highest frequency f2 are in a relationship of:

$$0.24 \leq |\log(f1) - \log(f2)| \leq 1.55$$

(3) A method of acid cleaning of steel plate as set forth in (1) or (2), characterized in that the acid cleaning solution includes ceramic or iron oxide particles with an average particle size of 0.05 to 50 μm.

(4) A method of acid cleaning of steel plate as set forth in any one of (1) to (3), characterized in that the microbubbles are a mixture of at least two types of microbubbles with different average bubble sizes.

(5) A method of acid cleaning of steel plate as set forth in (3), characterized in that the particles are a mixture of at least two types of particles with different average particle sizes.

(6) A method of acid cleaning of steel plate as set forth in any one of (1) to (5), characterized by using a reflecting plate which has a curved surface which is curved back from the steel plate so as to reflect the applied ultrasonic waves.

(7) An apparatus for acid cleaning of steel plate which is provided with at least an acid cleaning tank, an ultrasonic wave device which applies ultrasonic waves to an acid cleaning solution in the acid cleaning tank, and an acid cleaning solution feed device which feeds acid cleaning solution to the acid cleaning tank, the apparatus for acid cleaning of steel plate characterized in that it has means for feeding microbubbles to the acid cleaning solution feed device, the ultrasonic wave device can apply ultrasonic waves which have at least two types of frequencies, and the frequencies of the ultrasonic waves are 28.0 kHz or more and 1.0 MHz or less.

(8) A continuous acid cleaning system of steel plate as set forth in (7) characterized in the acid cleaning solution feed device further has means for feeding ceramic or iron oxide particles with an average particle size of 0.05 to 50 μm.

(9) A continuous acid cleaning system of steel plate as set forth in (7) or (8) characterized in that the means for feeding microbubbles can mix at least two types of microbubbles with different average bubble sizes.

(10) A continuous acid cleaning system of steel plate as set forth in (8) characterized in that the means for feeding particles can mix at least two types of particles with different average particle sizes.

(11) A continuous acid cleaning system of steel plate as set forth in any one of (7) to (10) characterized in that a reflecting plate which has a curved surface which is curved back from the steel plate running through the pickling tank and reflects the ultrasonic waves is set in the pickling tank.

Advantageous Effects of Invention

According to the present invention, it is possible to efficiently and effectively remove oxide scale from steel plate which contains silicon (Si) and form a clean surface free of descaling marks. Further, by improvement of the pickling rate, it is possible to clean steel plate by acid with a good productivity.

DESCRIPTION OF EMBODIMENTS

Figure 1:
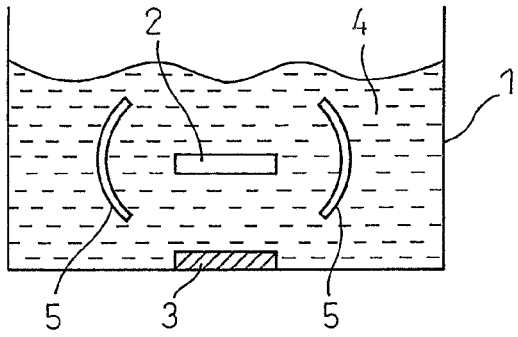
FIG. 1 is an explanatory view which shows an example of placing an ultrasonic oscillator and reflecting plates which have curved surfaces at a cleaning line which cleans a running steel plate.

The inventors discovered that by applying to a cleaning solution at least two types of ultrasonic waves with frequencies of 28.0 kHz or more to less than 1.0 MHz in range and by adding microbubbles to the cleaning solution, the cleaning solution becomes extremely effective for descaling of steel plate which contains Si. That is, it is possible to easily remove and uniformly remove oxide scale from steel plate which contains Si, for which descaling had been considered difficult up to now.

If investigating in detail the process by which oxide scale on steel plate which contains Si dissolves in a pickling solution, it is learned that the oxide scale gradually dissolves from the steel plate surface, there is a layer of concentrated Si-based oxides at the final stage when reaching the vicinity of the interface with the steel plate, and that at the part of this layer, the remaining oxide scale is slow to separate from the steel plate surface. For example, there is oxide scale comprised of $Fe_2O_3$, $Fe_3O_4$, FeO, and other Fe-based oxides and oxide scale under that (at interface with base iron) comprised of $Fe_2SiO_4$ and other Si-based oxides (concentrated layer of Si-based oxides). The layer comprised of the Si-based oxides made descaling difficult, but it became clear that if using the cleaning solution of the present invention, the layer can be easily removed.

Further, the concentrated layer of the Si-based oxides often becomes gel-like. The gel-like Si-based oxides are freed from the steel plate surface, but are observed to float near the surface in state. Furthermore, the phenomenon is also observed where part of that redeposits on the surface of the steel plate.

However, if using the cleaning method of the present invention, the phenomenon of such gel-like matter floating near the surface is not seen and therefore it was confirmed that the phenomenon of redeposition almost completely disappeared.

These effects are considered to be due to the synergistic action of the microbubbles which were added to the cleaning solution and the two types of ultrasonic waves in a specific frequency range.

The action of the microbubbles which are added to the cleaning solution is, first, to scatter the ultrasonic waves from the ultrasonic wave generator so that the ultrasonic waves evenly strike the surface of the object being cleaned, that is, the steel plate. At this time, there is little attenuation of the scattering of ultrasonic waves by the microbubbles. That is, microbubbles raise the efficiency of propagation of ultrasonic waves to the object being cleaned. Further, microbubbles also have the following action. The oxide scale, in particular the Si-based oxides etc., which are peeled off from the surface of the steel plate due to the acid of the cleaning solution and the ultrasonic waves, is taken into the vapor-liquid interfaces of the microbubbles and inside the bubbles whereby the cleaning action of the cleaning solution and ultrasonic waves is maintained. Further, the microbubbles also act to suppress redeposition of gel-like Si-based oxides.

To obtain such an action of microbubbles, it is sufficient to add microbubbles of an average bubble size of 0.01 to 100 μm to the cleaning solution. The "average bubble size" means the diameter of the largest number of specimens in the number distribution of the diameter of microbubbles. If the average bubble size is less than 0.01 μm, the bubble generation apparatus becomes large in scale and feed of bubbles with uniform bubble sizes becomes difficult. If the average bubble size exceeds 100 μm, the bubble flotation rate increases and the lifetime of the bubbles in the cleaning solution becomes short so practical cleaning sometimes becomes impossible. Further, if the bubble size is too large, sometimes the propagation of the ultrasonic waves is obstructed by the microbubbles and sometimes the effect of improvement of the cleaning ability by the ultrasonic waves ends up falling. When removing oxide scale from steel plate which contains Si, to obtain the above-mentioned action of microbubbles more effectively, the average bubble size of the microbubbles is preferably 0.01 to 100 μm. More preferable is 0.1 to 80 μm.

Further, the concentration (density) of the microbubbles in the cleaning solution is preferably 500/ml to 500,000/ml. If less than 500/ml, the above-mentioned action of microbubbles sometimes cannot be sufficiently obtained. If over 500,000/ml, the bubble generation apparatus becomes large in scale or the number of bubble generation apparatuses is increased. Sometimes feed of microbubbles becomes impractical. In the case of removing oxide scale from steel plate which contains Si, to obtain the above-mentioned action of microbubbles more effectively, a concentration of microbubbles of 5000/ml to 500,000/ml is preferable. More preferable is 10,000/ml to 500,000/ml.

The average bubble size or concentration (density) of the microbubbles can be measured by a liquid-borne particle counter, a bubble spectrometer, etc. For example, there are the SALD-7100 (Shimadzu Corporation), Multisizer 4 (Beckman Coulter), VisiSizer system (Japan Laser), acoustic bubble spectrometer (ABS) (West Japan Fluid Engineering Laboratory), LiQuilaz-E20/E20P (Sonac), KS-42D (Rion), and other devices. The size and concentration of microbubbles in the examples of the present invention are measured by the above particle counter or bubble spectrometer or measuring devices equivalent to those devices. Further, the "average bubble size" referred to here is the number average bubble size.

The basic mechanisms for generation of microbubbles are shearing of bubbles, passage of bubbles through micropores, pressurized dissolution of gases, ultrasonic waves, electrolysis, chemical reactions, etc. In the present invention, any method may be used. A method of generation of microbubbles which enables easy control of the size and concentration of microbubbles is preferable. For example, it is possible to use the shearing method to generate microbubbles, then pass the cleaning solution through a filter having micropores of a predetermined size so as to control the size of the microbubbles and use them for cleaning.

The frequency of ultrasonic waves, as mentioned above, is preferably a frequency of 28 kHz or more to less than 1 MHz. If applying two or more types of ultrasonic waves differing in frequency (wavelength) in this range of frequency to the cleaning solution together with the microbubbles, the solution becomes effective for descaling of steel plate which contains Si. This is believed to be due to the following action.

First, the wavelength of the ultrasonic waves and the thickness of the readily removed scale are in a special relationship. The larger the wavelength (the lower the frequency), the greater the thickness of easily removable scale. For example, 38 kHz is superior for removal of scale of a thickness of 10 to 30 μm or so, while 100 kHz is superior for removal of scale of a thickness of 1 to 5 μm or so. In general, by experience, the following relationship stands between the wavelength L (mm) of the ultrasonic waves and the thickness S (μm) of the easily removable scale.

$$S=1000\times(L/3500)$$

Further, the wavelength L (mm) of the ultrasonic waves is found by $$L=1000\times(V/F)$$

from the frequency of ultrasonic waves F (Hz) when making the speed of sound V(m/s). IF the speed of sound V in water is 144 m/s, at 38 kHz, it is calculated that L=38 mm and S=11 μm. At 100 kHz, it is calculated that L=14.4 mm and S=4 μm.

Therefore, for deposits like oxide scale where the thickness is not uniform, but there is a range of thickness, application of at least two types of ultrasonic waves of different frequencies acts widely on any thickness of oxide scale.

Further, the ultrasonic waves which are generated from the ultrasonic wave generator preferably do not attenuate much at all until reaching the object being removed, that is, the oxide scale. In general, high frequency ultrasonic waves easily attenuate, while low frequency ultrasonic waves are hard to attenuate and reach points far from the generator without much attenuation. Therefore, if by the same intensity of generation, with low frequency ultrasonic waves, the intensity does not attenuate and the removability of the oxide scale is maintained, but with high frequency ultrasonic waves, the intensity attenuates, so a problem arises in the removability of the oxide scale. In particular, when the distance from the position of the generator to the steel plate is large or when microbubbles cause the ultrasonic waves to scatter (the actual distance of transmission of ultrasonic waves becomes larger), attenuation of the high frequency ultrasonic waves becomes remarkable.

However, it was confirmed that in a cleaning solution in which microbubbles are contained, if applying low frequency ultrasonic waves simultaneously with high frequency ultrasonic waves, efficient removal of oxide scale of a size believed due to the high frequency ultrasonic waves is also possible. In particular, it was discovered that by applying at least two types of ultrasonic waves of frequencies in the relationship of formula 1, a remarkable effect of removal can be obtained.

$$0.24\leq|\log(f1)-\log(f2)|\leq1.55 \quad \text{(formula 1)}$$

That is, if applying ultrasonic waves of the frequency of f1 and ultrasonic waves of the frequency of f2 in the relationship of formula 1 to a cleaning solution in which microbubbles are contained, the removal of oxide scale of steel plate containing silicon (Si) dipped in the cleaning solution becomes further efficient and uniform. In the case of ultrasonic waves which include three or more frequencies, the lowest low frequency f1 and the highest frequency f2 should be made to satisfy formula 1.

If combining high frequency ultrasonic waves and low frequency ultrasonic waves in the relationship of formula 1, it is believed that the high frequency ultrasonic waves are superposed on the hard to attenuate low frequency ultrasonic waves and therefore the high frequency ultrasonic waves also reach the steel plate without being attenuated (with attenuation being suppressed). For this reason, it is surmised that the oxide scale can be efficiently and uniformly removed. The effect becomes particularly effective in steel plate which contains Si for which descaling is difficult.

For descaling of steel plate which contains Si, it is possible to effectively remove the oxide scale if applying ultrasonic waves which have a plurality of frequencies to a cleaning solution in which microbubbles are included because, it is surmised, the ultrasonic waves effectively act on the above-mentioned layer comprised of Si-based oxides. By having high frequency ultrasonic waves be applied superposed on the low frequency ultrasonic waves in the above-mentioned way, it is also possible that the ultrasonic waves effectively act on the oxide scale comprised of Si-based oxides below the oxide scale comprised of Fe-based oxides as well, thereby facilitating descaling.

Further, if applying ultrasonic waves under the above-mentioned conditions, it is possible to understand that the physical impact causes cracks to form in the oxide scale and the acidic cleaning solution penetrates through the cracks to the inside of the scale whereby efficient descaling becomes possible.

Here, the frequencies of the ultrasonic waves have to be 28.0 kHz or more to less than 1.0 MHz in range. If using a frequency of less than 28 kHz, the reaction between the steel plate and the pickling solution causes bubbles of 500 μm or more size to be generated from the steel plate surface. Due to these large bubbles, the propagation of ultrasonic waves is obstructed and the effect of improvement of dissolution by the ultrasonic waves falls. On the other hand, if using a frequency of 1 MHz or more, the straight line progression of ultrasonic waves becomes stronger and the uniformity of cleaning will sometimes drop. With ultrasonic waves of a frequency of 1 MHz or more, even if microbubbles are present, it will become hard for the ultrasonic waves to scatter them in the cleaning solution and the oxide scale will not be able to be uniformly cleaned off.

The frequencies may be set more preferably to 35 to 430 kHz, still more preferably to 35 to 200 kHz in range.

It is confirmed that the pickling method according to the present invention gives an excellent effect of improvement of efficiency of descaling in steel plate with a content of Si in the steel plate of 0.1 mass % to 7.00 mass %. Here, the "effect of improvement of efficiency of descaling" means the effect whereby, when under the same solution conditions, descaling can be completed in a shorter time (faster running speed) or, when in the same time, descaling can be completed even under conditions of a lower temperature or lower acid concentration.

With 0.75 mass % to 7.00 mass % Si steel plate, a further excellent effect of improvement of efficiency of descaling is obtained, while with 1.0 to 3.5 mass % Si steel plate, a more remarkable effect of improvement of efficiency of descaling is obtained. If the content of Si which is contained in the steel plate becomes 0.75 mass % or more, a layer comprised of Si-based oxides easily forms, so a remarkable effect of improvement of the efficiency of descaling is obtained, while with 1.0 mass % or more, the effect of improvement of efficiency of descaling is remarkably obtained. On the other hand, if the content of Si which is contained in the steel plate exceeds 7.00 mass %, the structure of the oxide scale will no longer change, so the effect of improvement of the efficiency of descaling which is obtained will no longer change and the descaling efficiency will sometimes become constant over that. In particular, if 3.5 mass % or more, the descaling ability gradually becomes poorer and descaling becomes difficult even if applying ultrasonic waves and microbubbles. Therefore, the effect appears more conspicuously at 1.0 to 3.5 mass %.

Next, the effect of adding particles will be explained. By introducing, into the cleaning solution, particles of, for example, magnesia (MgO), alumina ($Al_2O_3$), silicon nitride ($Si_3N_4$), silica ($SiO_2$), or other ceramic particles or iron oxide ($Fe_2O_3$, $Fe_3O_4$) particles, in addition to the improvement of cleanability by cavitation due to the ultrasonic waves, the impact force due to the particles striking the surface of the object being cleaned enables the oxide scale to be removed more effectively. Furthermore, by making the particle size about half the size of the microbubbles, the impact force due to impact of the particles is secured without propagation of the ultrasonic waves being obstructed and the efficiency of descaling is improved more. The effect of improvement of descaling due to addition of particles is also obtained even when applying ultrasonic waves of one type of frequency, but becomes more remarkable when applying two or more types of ultrasonic waves of different frequencies (wavelengths) as mentioned above.

The size of the particles used (average particle size) is 0.05 to 50 μm, more preferably 0.05 to 30 μm. As the concentration of the particles in the solution, several hundred per ml or several tens of thousands per ml is preferable. Further, as the solution concentration, 500/ml to 5000/ml is preferable. When using particles of an average particle size of less than 0.05 μm, sometimes the impact force of the particles striking the surface of the object being cleaned becomes weaker and improvement of descaling can no longer be expected. Further, if the particle size is too small, sometimes the particles are trapped inside the microbubbles or at the vapor-liquid interfaces and even if ultrasonic waves are applied, the particles will not strike the surface of the object being cleaned and therefore no effect of improvement of descaling due to addition of particles can be obtained. When using particles of an average particle size of over 50 μm, the propagation of ultrasonic waves and the movement of microbubbles to the surface of the object being cleaned are obstructed, so the cleaning power falls. Further, if large particles, the microbubbles end up sticking to the particle surfaces and the concentration of effective microbubbles de facto falls, so a sufficient cleaning power can no longer be obtained. Note that, as the method of measurement of the size of the particles in the present invention, for example, a spectrometer using the laser diffraction scattering method or the pore electrical resistance method or the method of measuring the particle size distribution by image analysis may be mentioned. Further, the "average particle size" referred to here means the number average particle size.

Further, the relationship between the coexisting microbubbles and particles is more preferably an average particle size Dp of the particles with respect to an average bubble size Dm of the microbubbles of $Dm/2 \leq Dp \leq 2 \times Dm$, still more preferably $Dm/2 \leq Dp \leq Dm$. If $Dp < Dm/2$, the energy given by the collision of particles becomes smaller, so the effect becomes smaller. Further, if $Dp > 2 \times Dm$, the particles obstruct the propagation of ultrasonic waves and the uniform distribution of microbubbles, so the effect becomes smaller. If in the above such relationship, the stability of the microbubbles is improved more, the microbubbles and particles effectively scatter the ultrasonic waves, and, furthermore, the impact of the particles against the surface of the object being cleaned becomes more effective, so as a result it is considered that a superior descaling effect is obtained and uniform descaling becomes possible.

Further, regarding the size of the particles, a mixture of at least two types of particles of different average particle sizes in the range of 0.05 to 50 μm average particle size is more preferable. As the two types of average particle size, a combination of at least two types of a range of 3 to 20 μm and a range of over 20 μm to 50 μm or less is still more preferable.

Further, regarding the size of the microbubbles, a mixture of at least two types of microbubbles of different average bubble sizes is more preferable. As the two types of average bubble size, a combination of at least two types of a range of 0.1 to 35 μm and a range of over 35 μm to 100 μm or less is still more preferable.

The bubble sizes of the microbubbles have to be selected corresponding to the ultrasonic wave frequencies. In a frequency of ultrasonic waves of 28 kHz to 1.0 MHz, $$0.22 \leq |\log(m1) - \log(m2)| \leq 1.52$$

is preferable.

Here, m1 and m2 are bubble sizes of the microbubbles (μm).

In the more preferable range of ultrasonic wave frequency of 35 to 430 kHz, $$0.28 \leq |\log(m1) - \log(m2)| \leq 1.08$$

is preferable.

Furthermore, in the still more preferable range of ultrasonic wave frequency of 35 to 200 kHz, $$0.28 \leq |\log(m1) - \log(m2)| \leq 0.75$$

is preferable.

The acidic cleaning solution (acid cleaning solution) according to the present invention may be a usual pickling solution for removal of oxide scale. For example, a hydrochloric acid aqueous solution, sulfuric acid aqueous solution, fluoric acid aqueous solution (hydrofluoric acid) or aqueous solutions of these solutions in which nitric acid, acetic acid, formic acid, etc. are contained may be used. The concentration of acid of the pickling solution is not particularly limited, but is 2 mass % to 20 mass % in range. If less than 2 mass %, sometimes a sufficient rate of dissolution of the oxide scale cannot be obtained. If over 20 mass %, sometimes corrosion of the pickling tank becomes remarkable or sometimes the rinse tank has to be enlarged.

Further, the pickling solution may also have $Fe^{2+}$ ions added to it. An $Fe^{2+}$ ion concentration of 30 to 150 g/L is more preferable. If less than 30 g/L, stable pickling is sometimes not possible. If over 150 g/L, the pickling rate sometimes becomes slow. Further, the pickling solution may also have $Fe^{3+}$ ions added to it.

The temperature of the pickling solution is not particularly limited, but for the pickling efficiency, temperature control, etc., ordinary temperature to 97° C. is more preferable.

Figure 2:
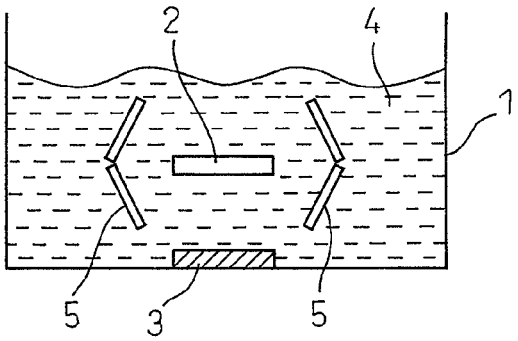
FIG. 2 is an explanatory view which shows an example of placing an ultrasonic oscillator and flat reflecting plates at a cleaning line which cleans a running steel plate.

If, like in the present invention, using both ultrasonic waves and microbubbles for the cleaning solution, it is preferable that the'ultrasonic waves be uniformly conveyed through the cleaning tank as a whole. Due to this, the uniformity of cleaning rises, but the ultrasonic waves are also propagated to the walls of the cleaning tank and other locations aside from the object being cleaned, so sometimes erosion is caused resulting in energy loss etc. and the output applied to the oscillator ends up being wasted. For this reason, by placing ultrasonic wave reflecting plates inside the cleaning tank, it is possible to effectively convey ultrasonic waves to the object being cleaned. As the placement method, it is preferable to place plates in a manner sandwiching the object being cleaned so that the curved surfaces are curved back from the object being cleaned such as shown in FIG. 1. Placing flat reflecting plates at positions such as shown in FIG. 2 can also be expected to be effective. The reflecting plates are preferably hard, high density materials. For example, steel plate, SUS plate, ceramic, etc. may be considered. Further, when chemical resistance is required in the pickling etc., use of acid-resistant bricks or other ceramic members may be considered.

Figure 3:
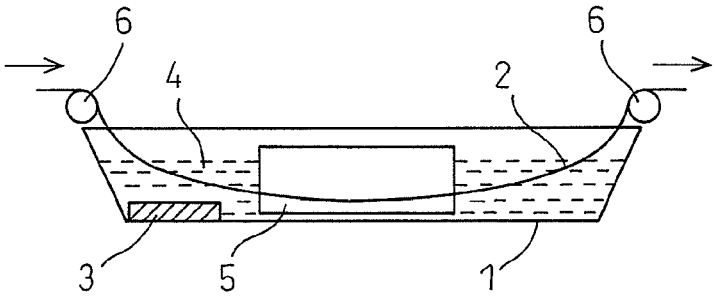
FIG. 3 is an explanatory view which shows an example of a cleaning line which cleans a running steel plate.
Figure 4:
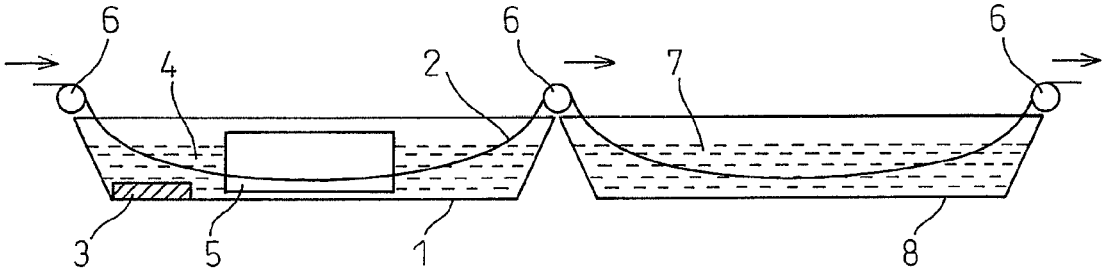
FIG. 4 is an explanatory view which shows an example of a cleaning line, comprised of a cleaning tank and a rinse tank, which cleans a running steel plate.

The pickling method of steel plate is generally applied in a cleaning line comprised of a pickling tank 1 such as shown in FIG. 3 and an acid cleaning system comprised of a pickling tank 1 and rinse tank 8 such as shown in FIG. 4. The steel plate 2 is run through these pickling systems for descaling. At this time, two or more of each of the pickling tank 1 and the rinse tank 8 may also be combined. Microbubble generation devices and microparticle addition devices are set at the pickling solution feed lines (systems) of these acid cleaning systems and predetermined size microbubbles and microparticle are added to the pickling solution 4 which is then placed in the pickling tank 1. The ultrasonic wave oscillator 3 may be placed at any position at the bottom or side of the tank so long as inside the pickling solution 4. Further, the orientation of the plane of vibration is also not limited. Furthermore, in the case of a cleaning line with a rinse tank 8, it is possible to introduce ultrasonic waves, microbubbles, and microparticles into the rinse tank 8 as well in accordance with need. Due to this, it is possible to raise the efficiency of the rinse.

Figure 5:
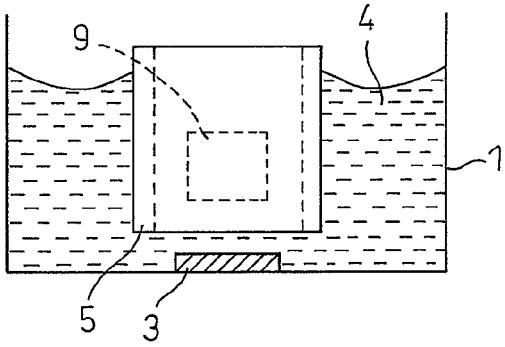
FIG. 5 is an explanatory view which shows an example of placing an ultrasonic oscillator and a reflecting plate in the case of cleaning an object being cleaned by dipping it in a cleaning solution.
Figure 6:
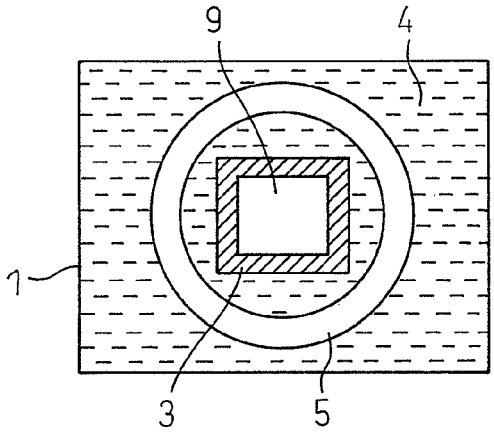
FIG. 6 is an explanatory view which shows an example of placing an ultrasonic oscillator and a reflecting plates, when viewed from above a cleaning tank, in the case of cleaning an object being cleaned by dipping it in a cleaning solution.

The pickling method of the steel plate can also be applied to descaling when dipping the steel plate 2 in the pickling tank 1. In this case as well, if microbubbles or microparticles are added to the pickling solution 4, the position of the ultrasonic wave oscillator 3 is not limited. Further, a cylindrical reflecting plate 5 which surrounds the object 9 being cleaned such as shown in FIG. 5 and FIG. 6 is preferably used.

EXAMPLES

Below, examples of the present invention will be explained.

Example 1

Hot rolled steels using silicon (Si) were used for tests for removal of oxide scale (pickling). The steel plates were comprised of C, 0.061 mass %, Si: 0.89 mass %, Mn: 1.19 mass %, P: 0.018 mass %, S: 0.0018 mass %, Al: 0.04 mass %, Ni: 0.021 mass %, Cr: 0.084 mass %, Cu: 0.016 mass %, and a balance of Fe and unavoidable impurities. Steel plates on the surface of which oxide scale was formed to 3 to 15 μm were used for the tests. As the pickling solution, a hydrochloric acid (HCl) aqueous solution was used. During the test, the solution was adjusted and controlled to contain hydrochloric acid in a range of 6 to 9 mass %. Furthermore, $FeCl_2$ was added to give a solution containing $Fe^{2+}$ by 80 g/L. Further, regarding $Fe^{3+}$ as well, similarly $FeCl_3$ was added to give a solution containing $Fe^{3+}$ by 1 g/L. The temperature of the pickling solution was raised to 85° C. (±5° C.).

The ultrasonic wave generation device used was one which had an output of 1200 W and an oscillator made of SUS and treated to make its surface acid resistant. The tests were conducted at the frequencies which are shown in Table 1. Before the pickling test, microbubbles of the average bubble sizes which are shown in Table 1 and MgO particles of the average particle sizes which are shown in Table 1 were added dispersed into an HCl aqueous solution and a pickling test run while applying ultrasonic waves. The microbubbles were formed using a 2FKV-27M/MX-F13 made by OHR Laboratory. The steel plate was run through the pickling tank by a speed of 100 m/min for a descaling test. The size of the microbubbles was measured using a bubble spectrometer. The particle size of the MgO particles was measured using a laser spectrometer (KS-42D made by Rion).

As the method of evaluation, the case where the area rate of removal of oxide scale of the steel plate surface after 30 seconds of pickling treatment was 100% or less to 95% or more was evaluated as "AA", the case where it was less than 95% to 90% or more as "A", the case where it was less than 90% to 85% or more as "BB", the case where it was less than 85% to 80% or more as "B", the case where it was less than 80% to 70% or more as "BC", the case where it was less than 70% to 60% or more as "C", the case where it was less than 60% to 50% or more as "CD", the case where it was less than 50% to 40% or more as "D", and the case where it was less than 40% as "X".

Table 1 shows the results of evaluation. If using ultrasonic waves of frequencies of 28.0 kHz or more to less than 1.0 kHz to apply ultrasonic waves by two types of frequency to a pickling solution into which microbubbles have been introduced, oxide scale could be effectively removed.

TABLE 1

| | Frequency of ultrasonic waves | | | | Microbubbles | Particles | | |
|---|---|---|---|---|---|---|---|---|
| No. | f1 (kHz) | f2 (kHz) | f3 (kHz) | \|log(f1) − log(f2)\| | Average bubble size (μm) | Particle size (μm) | Descaling rate | Remarks |
| 1-1 | 28 | 50 | — | 0.25 | 60 + 100 | — | A | Inv. ex. |
| 1-2 | 38 | 100 | — | 0.42 | 30 + 80 | — | AA | Inv. ex. |
| 1-3 | 38 | 100 | — | 0.42 | 30 + 80 | — | A | Inv. ex. |
| 1-4 | 38 | 100 | — | 0.42 | 30 + 200 | — | BB | Inv. ex. |
| 1-5 | 38 | 150 | — | 0.60 | 20 + 80 | — | AA | Inv. ex. |
| 1-6 | 38 | 150 | — | 0.60 | 20 + 200 | — | BB | Inv. ex. |
| 1-7 | 38 | 400 | — | 1.02 | 8 + 80 | — | BB | Inv. ex. |

TABLE 1-continued

| No. | Frequency of ultrasonic waves f1 (kHz) | f2 (kHz) | f3 (kHz) | \|log(f1) − log(f2)\| | Microbubbles Average bubble size (μm) | Particles Particle size (μm) | Descaling rate | Remarks |
|---|---|---|---|---|---|---|---|---|
| 1-8 | 38 | 990 | — | 1.42 | 3 + 80 | — | BB | Inv. ex. |
| 1-9 | 38 | 400 | 100 | 1.02 | 8 + 30 + 80 | — | AA | Inv. ex. |
| 1-10 | 38 | 990 | 100 | 1.42 | 3 + 30 + 80 | — | AA | Inv. ex. |
| 1-11 | 100 | 400 | — | 0.60 | 8 + 30 | — | B | Inv. ex. |
| 1-12 | 100 | 990 | — | 1.00 | 3 + 30 | — | B | Inv. ex. |
| 1-13 | 400 | 990 | — | 0.39 | 3 + 8 | — | B | Inv. ex. |
| 1-14 | 10 | 20 | — | 0.30 | 200 + 300 | — | X | Comp. ex. |
| 1-15 | 28 | 38 | — | 0.13 | 80 + 100 | — | D | Comp. ex. |
| 1-16 | 38 | 2000 | — | 1.72 | 30 + 80 | — | X | Comp. ex. |
| 1-17 | 28 | — | — | — | 100 | — | X | Comp. ex. |
| 1-18 | 38 | — | — | — | 80 | — | D | Comp. ex. |
| 1-19 | 100 | — | — | — | 30 | — | D | Comp. ex. |
| 1-20 | 430 | — | — | — | 8 | — | X | Comp. ex. |
| 1-21 | 990 | — | — | — | 3 | — | X | Comp. ex. |

Example 2

Next, steel plates of the same materials as in Example 1 on the surfaces of which oxide scale was formed to 5 to 20 μm were used for descaling. The pickling solution, microbubbles, added particles, and ultrasonic wave device were made the same as Example 1. The same procedure was followed as in Example 1 for 30-second pickling treatment, then the steel plate surface was evaluated by the area rate of removal of oxide scale.

Table 2 shows the evaluation results. It was confirmed that if using ultrasonic waves of frequencies of 28.0 kHz or more to less than 1.0 kHz so as to apply ultrasonic waves by two types of frequency to a pickling solution into which microbubbles have been introduced, it is possible to effectively remove oxide scale in the same way as in Example 1.

TABLE 2

| No. | Frequency of ultrasonic waves f1 (kHz) | f2 (kHz) | f3 (kHz) | \|log(f1) − log(f2)\| | Microbubbles Average bubble size (μm) | Particles Particle size (μm) | Descaling rate | Remarks |
|---|---|---|---|---|---|---|---|---|
| 2-1 | 28 | 50 | — | 0.25 | 60 + 100 | 20 | A | Inv. ex. |
| 2-2 | 38 | 72 | — | 0.28 | 40 + 80 | 30 | AA | Inv. ex. |
| 2-3 | 38 | 72 | — | 0.28 | 40 + 80 | 10 | A | Inv. ex. |
| 2-4 | 38 | 72 | — | 0.28 | 40 + 200 | 30 | A | Inv. ex. |
| 2-5 | 38 | 100 | — | 0.42 | 30 + 80 | 30 | AA | Inv. ex. |
| 2-6 | 38 | 100 | — | 0.42 | 30 + 80 | 50 | A | Inv. ex. |
| 2-7 | 38 | 100 | — | 0.42 | 30 + 80 | 100 | B | Inv. ex. |
| 2-8 | 38 | 100 | — | 0.42 | 30 + 200 | 30 | A | Inv. ex. |
| 2-9 | 38 | 150 | — | 0.60 | 30 + 80 | 30 | AA | Inv. ex. |
| 2-10 | 38 | 150 | — | 0.60 | 20 + 200 | 50 | A | Inv. ex. |
| 2-11 | 38 | 400 | — | 1.02 | 8 + 80 | 0.5 | A | Inv. ex. |
| 2-12 | 38 | 400 | — | 1.02 | 8 + 80 | 30 | A | Inv. ex. |
| 2-13 | 38 | 990 | — | 1.42 | 3 + 80 | 30 | B | Inv. ex. |
| 2-14 | 38 | 400 | 100 | 1.02 | 8 + 30 + 80 | 30 | AA | Inv. ex. |
| 2-15 | 38 | 990 | 100 | 1.42 | 3 + 30 + 80 | 30 | AA | Inv. ex. |
| 2-16 | 38 | 990 | — | 1.42 | 3 + 80 | 0.05 | A | Inv. ex. |
| 2-17 | 38 | 990 | — | 1.42 | 3 + 80 | 30 | A | Inv. ex. |
| 2-18 | 100 | 400 | — | 0.60 | 8 + 30 | 10 | BB | Inv. ex. |
| 2-19 | 100 | 990 | — | 1.00 | 3 + 30 | 10 | BB | Inv. ex. |
| 2-20 | 400 | 990 | — | 0.39 | 3 + 8 | 2 | BB | Inv. ex. |
| 2-21 | 10 | 20 | — | 0.30 | 200 + 300 | 100 | X | Comp. ex. |
| 2-22 | 28 | 38 | — | 0.13 | 80 + 100 | 50 | D | Comp. ex. |
| 2-23 | 38 | 2000 | — | 1.72 | 30 + 80 | 30 | X | Comp. ex. |
| 2-24 | 100 | 150 | — | 0.18 | 20 + 30 | 30 | D | Comp. ex. |
| 2-25 | 28 | — | — | — | 100 | 30 | X | Comp. ex. |
| 2-26 | 38 | — | — | — | 80 | 30 | D | Comp. ex. |
| 2-27 | 100 | — | — | — | 30 | 30 | D | Comp. ex. |
| 2-28 | 430 | — | — | — | 8 | 30 | X | Comp. ex. |
| 2-29 | 990 | — | — | — | 3 | 30 | X | Comp. ex. |

Example 3

Next, steel materials of different contents of Si were used to run tests for removal of oxide scale (pickling). The steel materials were comprised of C: 0.061 mass %, Mn: 1.01 mass %, P: 0.015 mass %, S: 0.0017 mass %, Al: 0.03 mass %, Ni: 0.020 mass %, Cr: 0.085 mass %, Cu: 0.015 mass %, and a balance of Fe and unavoidable impurities. The test materials which were used for the tests were comprised of steel plates on the surface of which oxide scale was formed to 3 to 25 μm. The average of the thicknesses of oxide scale of 24 test materials was 10 μm. As the pickling solution, an HCl aqueous solution was used. During the tests, the solution was adjusted and controlled to contain hydrochloric acid in a range of 6 to 9 mass %. Furthermore, $FeCl_2$ was added to give a solution containing $Fe^{2+}$ by 75 g/L. Further, regarding $Fe^{3+}$ as well, similarly $FeCl_3$ was added to give a solution containing $Fe^{3+}$ by 1.1 g/L. The temperature of the pickling solution was raised to 85° C. (±5° C.).

The ultrasonic wave generation apparatus used was one, in the same way as Examples 1 and 2, which had an output of 1200 W and a oscillator made of SUS and treated to make its surface acid resistant. The tests were conducted at the frequencies which are shown in Table 3. Before the pickling test, microbubbles of the average bubble sizes which are shown in Table 3 and alumina particles of the average particle sizes which are shown in Table 3 were dispersed into an HCl aqueous solution and a pickling test run while applying ultrasonic waves. The steel plate was run through the pickling tank by a speed of 100 m/min for a descaling test. The size of the microbubbles was measured using a bubble spectrometer.

5) The case where it was less than 80% to 70% or more was evaluated as "BC".

6) The case where it was less than 70% to 60% or more as "C".

7) The case where it was less than 60% to 50% or more was evaluated as "CD".

8) The case where it was less than 50% to 40% or more was evaluated as "D".

9) The case where it was less than 40% was evaluated as "X".

Table 3 shows the results of evaluation. With steel plate with a content of Si of 0.1 mass % to 7.00 mass %, an excellent effect of improvement of efficiency in descaling can be obtained.

TABLE 3

| | Steel plate to be pickled | Frequency of ultrasonic waves | | | Microbubbles | Particles | | |
|---|---|---|---|---|---|---|---|---|
| No. | Si content (mass %) | f1 (kHz) | f2 (kHz) | \|log(f1) − log(f2)\| | Average bubble size (μm) | Particle size (μm) | Descaling rate | Remarks |
| 3-1 | 0 | 28 | 100 | 0.55 | 30 + 100 | — | AA | Inv. ex. |
| 3-2 | 0.05 | 28 | 100 | 0.55 | 30 + 100 | — | AA | Inv. ex. |
| 3-3 | 0.1 | 28 | 100 | 0.55 | 30 + 100 | — | A | Inv. ex. |
| 3-4 | 0.5 | 28 | 100 | 0.55 | 30 + 100 | — | A | Inv. ex. |
| 3-5 | 0.75 | 28 | 100 | 0.55 | 30 + 100 | — | A | Inv. ex. |
| 3-6 | 1.0 | 28 | 100 | 0.55 | 30 + 100 | — | A | Inv. ex. |
| 3-7 | 2.0 | 28 | 100 | 0.55 | 30 + 100 | — | A | Inv. ex. |
| 3-8 | 3.0 | 28 | 100 | 0.55 | 30 + 100 | — | A | Inv. ex. |
| 3-9 | 3.5 | 28 | 100 | 0.55 | 30 + 100 | — | A | Inv. ex. |
| 3-10 | 3.6 | 28 | 100 | 0.55 | 30 + 100 | — | BB | Inv. ex. |
| 3-11 | 7.0 | 28 | 100 | 0.55 | 30 + 100 | — | BB | Inv. ex. |
| 3-12 | 7.5 | 28 | 100 | 0.55 | 30 + 100 | — | B | Inv. ex. |
| 3-13 | 0 | 28 | 100 | 0.55 | 30 + 100 | 15 | AA | Inv. ex. |
| 3-14 | 0.05 | 28 | 100 | 0.55 | 30 + 100 | 15 | AA | Inv. ex. |
| 3-15 | 0.1 | 28 | 100 | 0.55 | 30 + 100 | 15 | AA | Inv. ex. |
| 3-16 | 0.5 | 28 | 100 | 0.55 | 30 + 100 | 15 | AA | Inv. ex. |
| 3-17 | 0.75 | 28 | 100 | 0.55 | 30 + 100 | 15 | AA | Inv. ex. |
| 3-18 | 1.0 | 28 | 100 | 0.55 | 30 + 100 | 15 | AA | Inv. ex. |
| 3-19 | 2.0 | 28 | 100 | 0.55 | 30 + 100 | 15 | AA | Inv. ex. |
| 3-20 | 3.0 | 28 | 100 | 0.55 | 30 + 100 | 15 | AA | Inv. ex. |
| 3-21 | 3.5 | 28 | 100 | 0.55 | 30 + 100 | 15 | AA | Inv. ex. |
| 3-22 | 3.6 | 28 | 100 | 0.55 | 30 + 100 | 15 | A | Inv. ex. |
| 3-23 | 7.0 | 28 | 100 | 0.55 | 30 + 100 | 15 | A | Inv. ex. |
| 3-24 | 7.5 | 28 | 100 | 0.55 | 30 + 100 | 15 | BB | Inv. ex. |
| 3-25 | 0 | 38 | — | — | 100 | 15 | D | Comp. ex. |
| 3-26 | 0.05 | 38 | — | — | 100 | 15 | D | Comp. ex. |
| 3-27 | 0.1 | 38 | — | — | 100 | 15 | D | Comp. ex. |
| 3-28 | 0.5 | 38 | — | — | 100 | 15 | X | Comp. ex. |
| 3-29 | 0.75 | 38 | — | — | 100 | 15 | X | Comp. ex. |
| 3-30 | 1.0 | 38 | — | — | 100 | 15 | X | Comp. ex. |
| 3-31 | 2.0 | 38 | — | — | 100 | 15 | X | Comp. ex. |
| 3-32 | 3.0 | 38 | — | — | 100 | 15 | X | Comp. ex. |
| 3-33 | 3.5 | 38 | — | — | 100 | 15 | X | Comp. ex. |
| 3-34 | 3.6 | 38 | — | — | 100 | 15 | X | Comp. ex. |
| 3-35 | 7.0 | 38 | — | — | 100 | 15 | X | Comp. ex. |
| 3-36 | 7.5 | 38 | — | — | 100 | 15 | X | Comp. ex. |

The particle size of the alumina microparticles was measured using a laser obscuration type particle counter.

The method of evaluation is as follows:

1) The case where the area rate of removal of oxide scale of the steel plate surface after 40-second pickling treatment was 100% or less to 95% or more was evaluated as "AA".

2) The case where it was less than 95% to 90% or more was evaluated as "A".

3) The case where it was less than 90% to 85% or more was evaluated as "BB".

4) The case where it was less than 85% to 80% or more was evaluated as "B".

Above, preferred embodiments of the present invention were explained while referring to the attached drawings, but the present invention is not limited to these examples needless to say. It is clear that a person skilled in the art could conceive of various modifications or corrections within the scope described in the claims. These naturally also are understood as being included in the technical scope of the present invention.

INDUSTRIAL APPLICABILITY

The present invention can be utilized in acid cleaning of steel plate in the process of production of ferrous metals.

REFERENCE SIGNS LIST

1 cleaning tank
2 running steel plate
3 ultrasonic wave oscillator
4 cleaning solution containing microbubbles and microparticles
5 reflecting plate
6 roll
7 rinse solution
8 rinse tank
9 object being cleaned

The invention claimed is:

1. A method of acid cleaning of a steel plate which contains silicon, said method of acid cleaning of the steel plate characterized in that an acid cleaning solution contains microbubbles, ultrasonic waves which have at least two types of frequencies are applied to the acid cleaning solution, and the frequencies of the ultrasonic waves are frequencies of 28.0 kHz or more to less than 1.0 MHz, wherein, in said frequencies of the ultrasonic waves, a lowest frequency f1 and a highest frequency f2 are in a relationship of:

$$0.24 \leq |\log(f1) - \log(f2)| \leq 1.55.$$

2. A method of acid cleaning of a steel plate as set forth in claim 1, characterized in that said acid cleaning solution includes ceramic or iron oxide particles with an average particle size of 0.05 to 50 μm.

3. A method of acid cleaning of a steel plate as set forth in claim 1, characterized in that said microbubbles are a mixture of at least two types of microbubbles with different average bubble sizes.

4. A method of acid cleaning of a steel plate as set forth in claim 2, characterized in that said particles are a mixture of at least two types of particles with different average particle sizes.

5. A method of acid cleaning of a steel plate as set forth in claim 1, characterized by using a reflecting plate which has a curved surface which is curved back from said steel plate so as to reflect said applied ultrasonic waves.

6. A method of acid cleaning of a steel plate as set forth in claim 2, characterized in that said microbubbles are a mixture of at least two types of microbubbles with different average bubble sizes.

7. A method of acid cleaning of a steel plate as set forth in claim 2, characterized by using a reflecting plate which has a curved surface which is curved back from said steel plate so as to reflect said applied ultrasonic waves.

8. A method of acid cleaning of a steel plate as set forth in claim 3, characterized by using a reflecting plate which has a curved surface which is curved back from said steel plate so as to reflect said applied ultrasonic waves.

9. A method of acid cleaning of a steel plate as set forth in claim 4, characterized by using a reflecting plate which has a curved surface which is curved back from said steel plate so as to reflect said applied ultrasonic waves.

* * * * *